United States Patent [19]

Willmann

[11] 4,244,438

[45] Jan. 13, 1981

[54] ENCASED INTERNAL COMBUSTION ENGINE, IN PARTICULAR FOR AN AUTOMOBILE

[75] Inventor: Michael Willmann, Wolfsburg, Fed. Rep. of Germany

[73] Assignee: Volkswagenwerk Aktiengesellschaft, Wolfsburg, Fed. Rep. of Germany

[21] Appl. No.: 42,791

[22] Filed: May 29, 1979

[30] Foreign Application Priority Data

Jun. 15, 1978 [DE] Fed. Rep. of Germany ..... 2826145

[51] Int. Cl.[3] ..... G10K 11/16

[52] U.S. Cl. ..... 181/204; 181/207; 123/198 E

[58] Field of Search ..... 181/200, 202, 204, 205, 181/207, 208; 123/198 C, 198 E

[56] References Cited

U.S. PATENT DOCUMENTS

| | | | |
|---|---|---|---|
| 3,112,810 | 12/1963 | Nallinger | 181/204 |
| 3,782,496 | 1/1974 | Thien et al. | 181/204 |
| 4,114,714 | 9/1978 | Fachbuck et al. | 181/204 |
| 4,137,888 | 2/1979 | Allan | 181/204 |
| 4,151,822 | 5/1979 | Miura et al. | 123/198 E |

*Primary Examiner*—L. T. Hix
*Assistant Examiner*—Benjamin R. Fuller
*Attorney, Agent, or Firm*—Brumbaugh, Graves, Donohue & Raymond

[57] ABSTRACT

An internal combustion engine for an automobile is encased in a sound-insulating casing and is mounted on a frame of the automobile via sound-proofing suspensions. The wall of the casing extends around the suspensions, at which point the casing is supported on the frame by means of casing wall portions. These casing wall portions are acoustically insulated from the remainder of the casing wall by sound-insulating intermediate layers, e.g. by flat, elastic, annular sealing rings.

6 Claims, 1 Drawing Figure

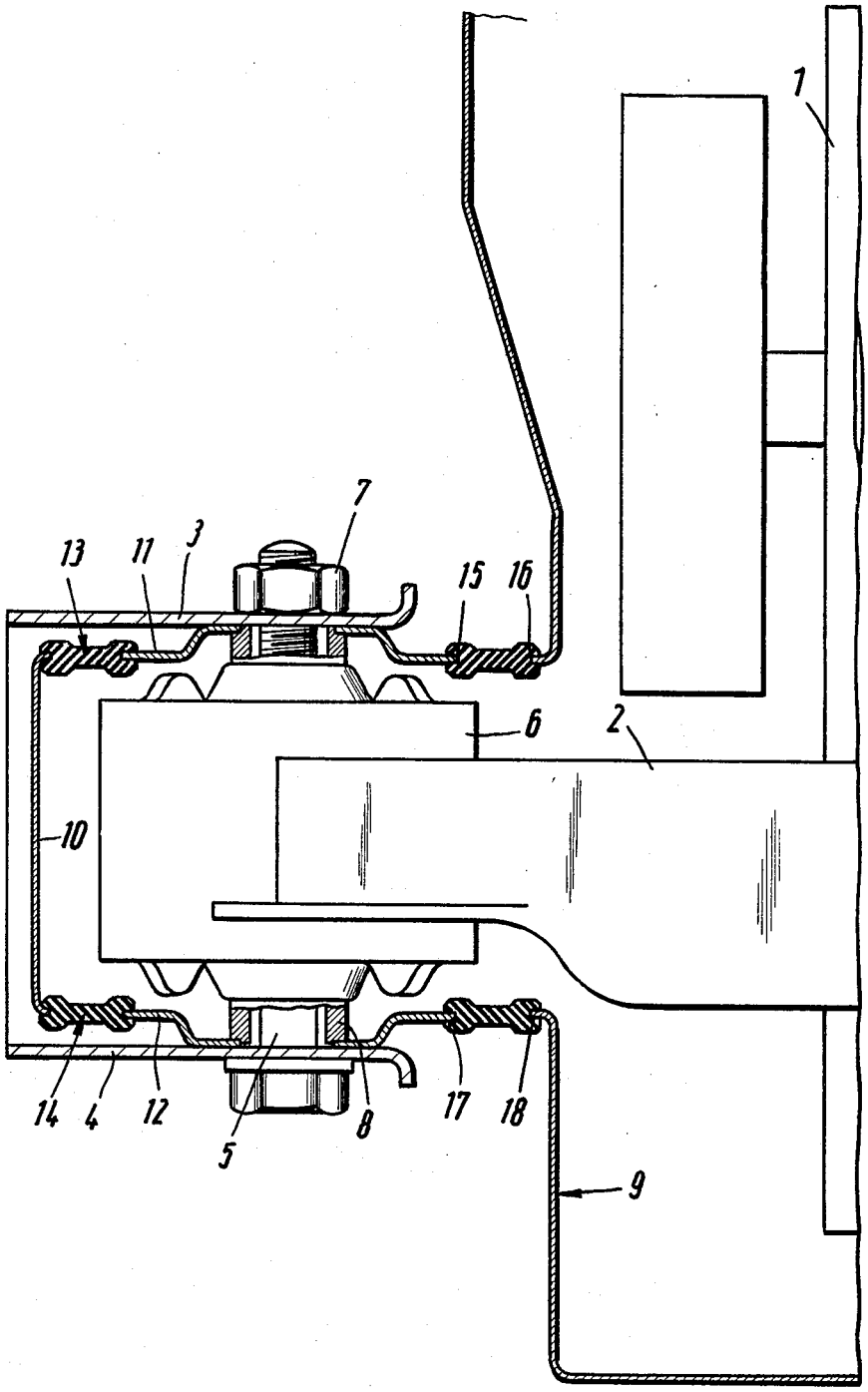
1
2
3
4
5
6
7
8
9
10
11
12
13
14
15
16
17
18

ENCASED INTERNAL COMBUSTION ENGINE, IN PARTICULAR FOR AN AUTOMOBILE

BACKGROUND OF THE INVENTION

This invention relates to an encased internal combustion engine and, more particularly, to sound-proofing suspensions for such an engine.

It is known that disturbing sounds due to the vibration of internal combustion engines can be reduced by enclosing the engine in a casing. Structures of this kind, which, as a rule, contain a supporting shell with sound-proofing overlays, are known per se. However, it is also necessary to prevent the casing supports from acting as a sound bridge and transmitting the noise of the engine to the vehicle on which it is mounted.

SUMMARY OF THE INVENTION

The present invention is directed to the mounting of an internal combustion engine, located within a sound-proof casing, on a vehicle, such that undesirable sounds are not transmitted to the vehicle. The attainment of this purpose is achieved by separating the portion of the casing at the common attachment points of the engine and casing to the vehicle, by means of acoustically insulating intermediate layers. Thus, an essential characteristic of the invention is the inclusion of at least some of the suspension points of the internal combustion engine in the casing, without causing individual walls or wall portions of the casing to act as sound bridges to the vehicle body.

BRIEF DESCRIPTION OF THE DRAWINGS

The foregoing and other features of the present invention will be more readily apparent from the following detailed description and drawing of an embodiment of the invention in which an encased automobile internal combustion engine is shown in a horizontal section.

DESCRIPTION OF A PREFERRED EMBODIMENT

The internal combustion engine proper, whose design is of no interest within the framework of the present invention, is designated by the reference numeral 1 and is illustrated schematically. For suspension of the engine 1 on the body of an automobile, the engine is equipped with several engine side arms 2, only one of which is shown in the figure. The suspension includes two retaining supports 3 and 4 of the vehicle body and the connection between these retaining supports and the arm 2 is effected by means of a screwed-in bolt 5. This bolt passes through corresponding aligned holes in the retaining supports 3 and 4 as well as through a sound-insulating element 6 which may be considered components of the arm 2. In this example, the bolt 5 is threaded and is fixed in place by means of a nut 7. The shaft of the bolt where it passes through the element 6 is surrounded by a spacer sleeve 8.

The internal combustion engine proper, including the essential parts of the suspension, is enclosed in a known type of casing 9 which, in a manner known per se, is rendered sound insulating.

A wall 10 of the casing 9 extends around the element 6, approximately in an eye or loop shape. The threaded bolt passes through holes in two mounting portions 11 and 12 of wall 10, which portions in this example are in the form of circular plates with cup-like, center-pushed-out regions. This manner of profile shaping the mounting wall portions 11 and 12 perpendicular to their main plane is motivated by the desire to limit relative movements between the internal combustion engine 1 and the vehicle frame, i.e., movements of the arm 2 in the direction of the axis of the threaded bolt 5 with respect to the retaining supports 3 and 4 of the frame.

These mounting wall portions 11 and 12 are also used to support the casing 9 on the vehicle frame. In order to prevent these wall portions from acting as sound transmitters between the remainder of the casing wall 10 and the vehicle frame, they are separated from the wall 10 of the casing 9. Accordingly, sound-insulating intermediate layers, e.g. circular members made of rubber, are inserted between the corresponding wall portions 11, 12 and the wall 10. These inserted intermediate members in this example are formed as flat annular sealing rings 13 and 14. On their inner and outer edges, these annular rings 13 and 14 are each provided with grooves 15, 16 and 17, 18, respectively, by means of which they embrace in a sealing manner the facing edges of the wall 10 and the wall portions 11, 12.

The invention offers in a structurally simple manner the possibility for a tightly sealed and elastic suspension of the casing which is vibration-insulated with respect to the internal combustion engine proper, as well as with respect to the vehicle body.

While the invention has been particularly shown and described with reference to a preferred embodiment thereof, it will be understood by those skilled in the art that various changes in form and details may be made therein without departing from the spirit and scope of the invention.

I claim:

1. An encased internal combustion engine, for example for an automobile, mounted on a frame via suspensions and enclosed in a sound-insulating casing with walls through which the suspensions pass, sound-insulating elements being interposed between the walls of the casing and the suspension, characterized in that the suspensions in each case contain an engine-side arm with a sound-insulating element that is passed through by an attachment means for fixing the engine on the frame; and the walls of the casing extend on all sides around the arm as well as the sound-insulating element and are supported on the frame by means of mounting wall portions of the casing through which the attachment means passes, which mounting wall portions are acoustically insulated relative to the remainder of the casing by means of sound-insulating intermediate layers inserted into the walls of the remainder of the casing and engaging the mounting wall portions.

2. An internal combustion engine as in claim 1, characterized in that the intermediate layers, within the limits of their inner and outer edges, are provided with grooves for receiving the edges of the remainder of the casing wall and the mounting wall portions.

3. An internal combustion engine in accordance with claims 1 or 2, characterized in that the mounting wall portions are profiled perpendicular to the plane of the wall of the casing so as to act as stops for limiting relative movement between the engine and the frame.

4. An internal combustion engine in accordance with claims 1 or 2 characterized in that the attachment means include bolts passing through retaining supports on the frame and in that the said bolts also pass through the mounting wall portions.

5. An internal combustion engine as in claim 4, characterized in that the bolts pass through the engine side arms and in that the mounting wall portions extend between said arms and the retaining supports.

6. An internal combustion engine as in claims 1 or 2, characterized in that the intermediate layers are also oil-tight.

* * * * *